United States Patent [19]

Nelson

[11] 4,318,355

[45] Mar. 9, 1982

[54] BURNER STRUCTURE FOR PARTICULATE FUELS

[76] Inventor: Wilbert K. Nelson, Box 231, Britt, Minn. 55710

[21] Appl. No.: 74,865

[22] Filed: Sep. 12, 1979

[51] Int. Cl.[3] ..... F23D 1/00

[52] U.S. Cl. ..... 110/104 R; 110/248; 110/261; 110/263; 110/347; 431/352; 431/353; 431/284; 126/99 C

[58] Field of Search ..... 431/171, 182, 183, 188, 431/352, 353; 126/99 C, 99 P; 110/248, 347, 260–263, 104 R

[56] References Cited

U.S. PATENT DOCUMENTS

| | | | |
|---|---|---|---|
| 5,871 | 5/1874 | Twitchell | 126/99 P |
| 1,165,607 | 12/1915 | Kress | 110/248 |
| 1,613,615 | 1/1927 | Lippert | 126/99 C |
| 1,697,524 | 1/1929 | Epstein | 126/99 C |
| 2,517,985 | 8/1950 | Davis | 431/352 |
| 2,616,252 | 11/1952 | Robinson et al. | 110/347 |
| 2,675,868 | 4/1954 | Ray | 431/352 |
| 2,806,516 | 9/1957 | Brola | 431/352 |
| 3,174,532 | 3/1965 | Ferree | 431/353 |
| 3,580,700 | 5/1971 | Hinckley | 431/353 |
| 3,630,651 | 12/1971 | Fay | 431/353 |
| 3,684,424 | 8/1972 | Zink et al. | 431/353 |
| 3,744,242 | 7/1973 | Stettler et al. | 431/116 |
| 3,796,209 | 3/1974 | Luft | 431/353 |
| 4,147,115 | 4/1979 | Leppert | 110/261 |
| 4,147,116 | 4/1979 | Graybill | 110/263 |
| 4,206,712 | 6/1980 | Vatsky | 431/284 |
| 4,221,174 | 9/1980 | Smith et al. | 110/263 |

*Primary Examiner*—Henry C. Yuen

*Attorney, Agent, or Firm*—Merchant, Gould, Smith, Edell, Welter & Schmidt

[57] ABSTRACT

A heater for burning particulate fuels in which a stream of air carrying combustible particles is injected upward into a combustion chamber (22) between two spaced perforated tubular members (33, 34), the outer member being taller. A deflector (55) located within the outer member and above the inner member causes the stream to flow outward and then upwardly, and helical vanes (139) may be provided between the members. A gun-type oil burner (61) is located below the members for initially heating them and igniting the particles. Particulate fuel is supplied through an auger 70 from a bin 71 which contains springs 77 rotated to prevent bridging or caking of the material. Rotation of the springs and drive of the auger are powered by a common motor 80.

8 Claims, 5 Drawing Figures

BURNER STRUCTURE FOR PARTICULATE FUELS

TECHNICAL FIELD

This invention relates to the field of heaters, and particularly to heaters for use with particulate fuels such as sawdust, powdered coal, or ground peat.

BACKGROUND

Heaters intended for use with particulate fuel are known, being taught for example in U.S. Pat. Nos. 1,614,314 to Murray et al., and 1,812,080 to Chapman, but have not solved with complete success the problems inherent in the nature of these fuels, their lack of uniformity and practical size, the frequent presence of non-gaseous products of combustion, and the need to maintain an effective ignition locale for maintaining combustion. Starting operation of such burners is also sometimes troublesome.

SUMMARY OF THE INVENTION

The present invention injects a stream of air carrying combustible particles upwardly into a combustion chamber, so that the stream enters two spaced tubular members open at both ends, the outer member being the taller. For burning sawdust, a grate to support the members is desirable. A deflector located within the outer member and above the inner member causes the stream to flow outwardly and then into the heat emitting body of the heater. The tubular members are perforated to improve combustion therein, and helical vanes may be provided between the members for the same reason. A gun type oil burner is located below the members for initially heating them and igniting the particles, but may be disabled after combustion of the particulate fuel is established. Means are provided for supplying additional air to the combustion chamber when desired, and for adjusting the location of the deflector to give maximum efficiency of combustion with fuels of different characteristics. Combustion products are led from the heat emitting body and to a flue, there being further provided a barometric damper and, if desired, a fly ash trap and heat reclaimer unit.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DETAILED DESCRIPTION OF THE INVENTION

Figure 1:
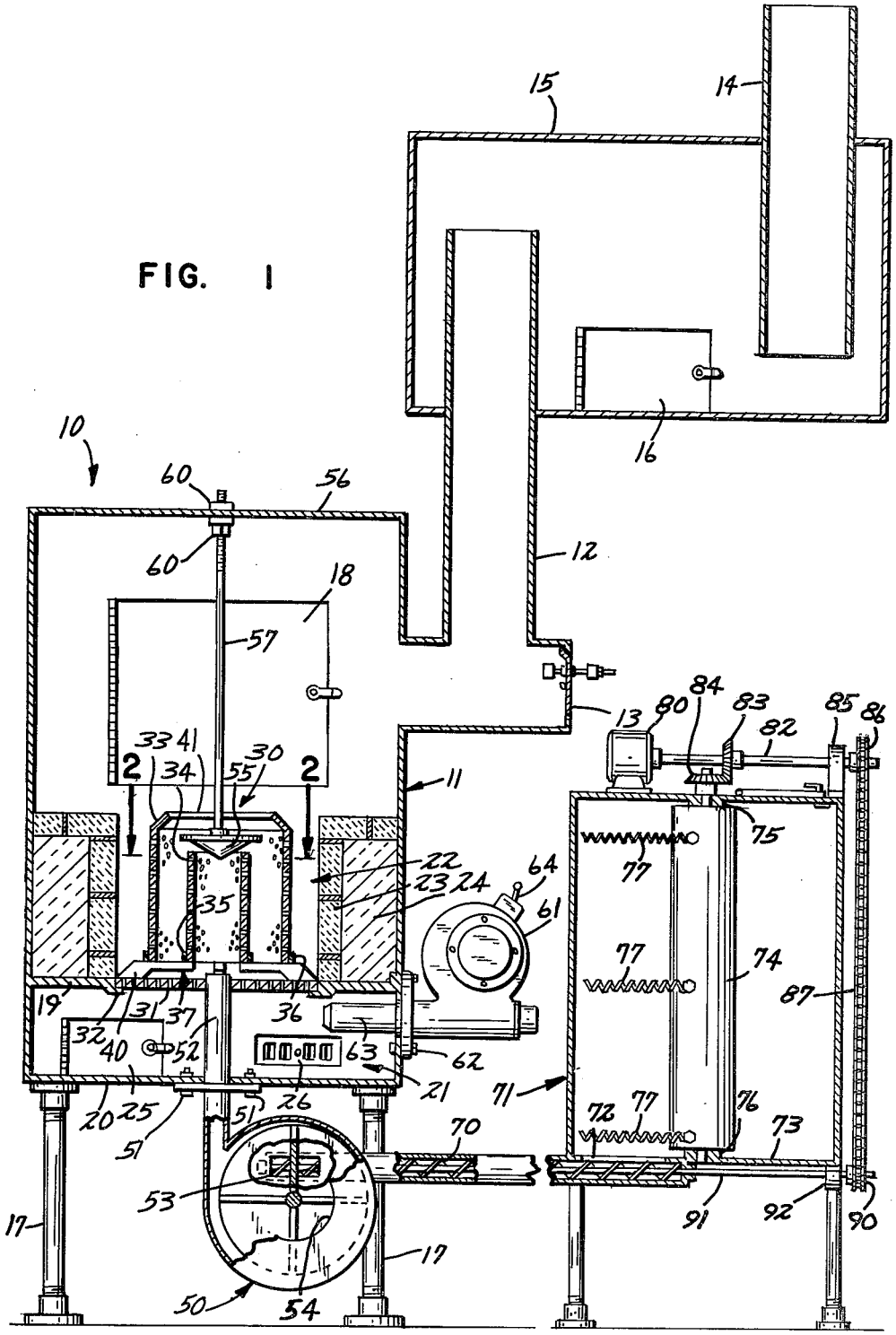
FIG. 1 is a schematic sectional view of a heater embodying the invention.
Figure 2:
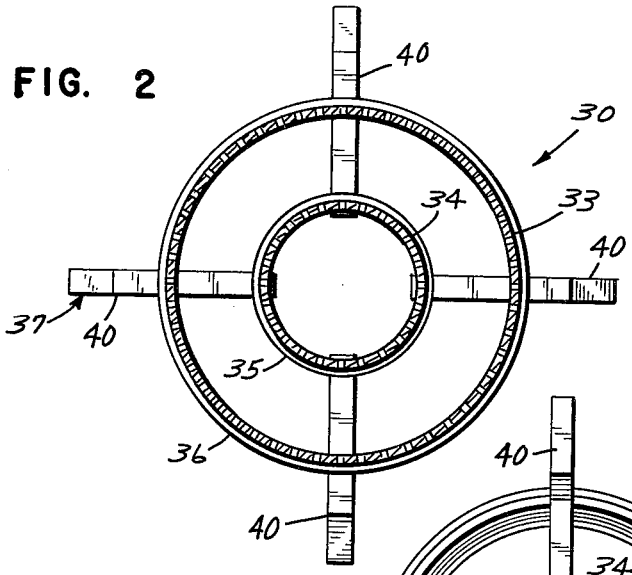
FIG. 2 is a fragmentary sectional view taken along the line 2—2 of FIG. 1.
Figure 3:
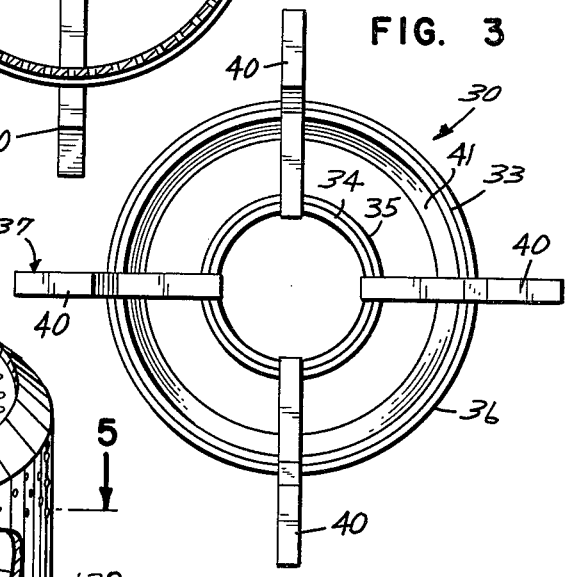
FIG. 3 is a bottom plan view of a component of the invention.

Turning first to FIGS. 1–3, a heater 10, according to my invention, is shown to comprise a heat emitting body 11 of suitable material such as steel. An outlet pipe 12 for combustion products is shown to include a barometric damper 13, and to be connected to a suitable flue 14 by a fly ash trap and heat reclaiming unit 15 with a clean-out door 16. Heater 10 is supported on suitable legs 17 and has a burner access door 18.

A partition 19 extends across body 11 somewhat above the bottom 20 thereof to define a lower chamber 21, and supports a combustion chamber 22 of firebrick 23 and heat insulation 24. Below partition 19 are a clean-out door 25 and an adjustable air inlet damper 26.

A burner structure 30 is supported in chamber 22, either on a grate 31 or on a grate supporting lip 32 of partition 19, depending on the fuel to be used: a grate is preferable when sawdust is being burned and may be constructed to shake ashes through if desired. Burner structure 30 is shown to comprise an outer tubular member 33 open at both ends and taller than an inner tubular member 34 also open at both ends. Members 33 and 34 are preferably of perforated Inconel or some other material resistant to heat and oxidation. As shown in FIGS. 2 and 3 the tubular members are preferably circular in section, and are received within the inner and outer rings 35 and 36 of a support spider 37 having a plurality of legs 40 of suitable size and shape to rest on grate 31 or on lip 32. The upper open end of member 35 may be inturned at a bevel 41, which need not be perforated.

The center of burner structure 30 is hollow to receive as fuel a stream of combustible fluid supplied as a mixture of combustible particles and air by a blower 50 mounted beneath the heater by suitable fasteners 51 and having a nozzle 52 extending upward through aligned apertures in the bottom 20 of body 11 and in grate 31, if such is used, to the open bottom of member 34. Particulate fuel is supplied to blower 50 through an opening 53, and air through an opening 54. A conical deflector 55 of suitable heat and oxidation resistant material is supported from the top 56 of body 11 on a mounting rod 57 having adjusting nuts 60, by which the height of deflector 55 relative to member 34 may be changed and fixed. Deflector 55 is larger in diameter than the top of member 34, but smaller than the top of member 33.

A gun type of oil burner 61 having an integral ignitor is mounted by suitable fasteners 62 with its nozzle 63 extending into chamber 21 below partition 19, so that its flame bathes nozzle 52 and passes up and through grate 31 and burner structure 30.

Fuel supply to opening 53 is provided by an auger 70 from a bin 71, through a suitable opening 72 in the bottom 73 of the bin. A vertical drum 74 is carried in bearings 75 and 76 in bin 71, for rotation about a vertical axis, and a number of loosely coiled springs 77 are secured to drum 74 and project therefrom generally horizontally. The diameter of drum 74 is large enough that springs 77 may wrap around it when bin 71 is full of fuel, without being distorted, and so may return to the straight position shown in the figure when the level of fuel in the bin falls. A motor 80 is mounted on the top 81 of bin 71, and its shaft 82 is coupled to drum 74 by bevel gears 83 and 84. Outboard of a bearing 85, shaft 81 carries a sprocket wheel 86, coupled by a sprocket chain 87 and a second sprocket wheel 90 to the shaft 91 of auger 70, outboard of a suitable bearing 92. Blower 50 is preferably powered by a second motor not shown.

Figure 4:
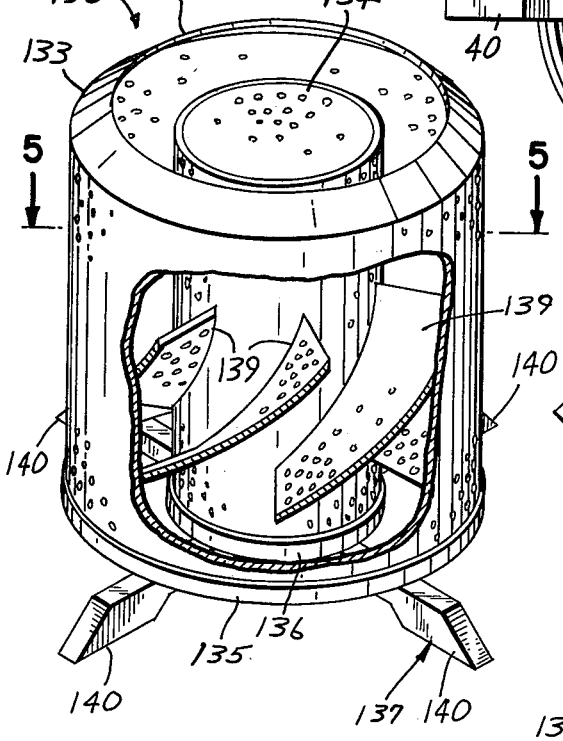
FIG. 4 is a perspective view of a portion of a second embodiment of the invention, parts being broken away for clarity of illustration.
Figure 5:
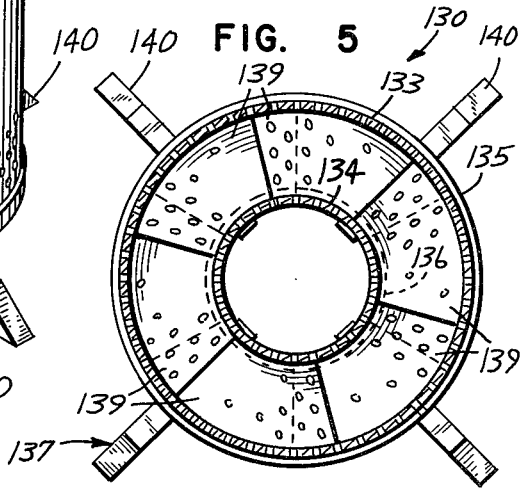
FIG. 5 is a sectional view taken along the line 5—5 of FIG. 4.

FIGS. 4 and 5 show a modified burner structure 130 including an outer member 133, with a bevel 141, and an inner member 134, mounted on a spider 137 having an outer ring 135, an inner ring 136, and feet 140. In this embodiment of the invention a plurality of helical vanes 139 are located between tubular members 133 and 134.

Operation

To use the heater, access door 18 is opened and the desired burner structure is inserted into the combustion chamber, grate 31 being also used if the intended fuel is sawdust. Deflector 55 is inserted and secured by nuts 60 at an initial position, and door 18 is closed. Damper 26 is also set to an initial position. Switch 64 is now closed and oil burner 61 heats the burner structure, combustion products being discharged through pipe 12 and unit 15 to flue 14. Particulate fuel is made available in bin 71, and motor 60 and blower 50 are set in operation, after a suitable preheat period if necessary. Operation of drum 74 and springs 77 prevents any caking or bridging in bin 71 from interrupting the continuous flow of particulate material through opening 72 to auger 70. A stream of air and fuel is projected into the burner structure and ignited, augmenting the heating of the burner structure and projecting hot combustion products upwardly out of the burner to warm the heat emitting body. Oil burner 61 may now be disabled at switch 64. The position of deflector 55 and the setting of damper 26 are now experimentally adjusted to the optimum for the fuel being burned, resulting in a very hot amber and blue flame similar to that of an acetylene torch, with minimum sooting, maximum heating, and minimum solid combustion products, which fall through the spider and grate or are swept into unit 15.

It will of course be understood that programming of the operation of motor 80, blower 50, and burner 61 is possible, if thermostatic control of heater 10 is desired.

Numerous characteristic and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. An apparatus for the combustion of particulate fuels, comprising:

an outer perforated tubular member and a shorter inner perforated tubular member, said members each having substantially open first and second ends;

means for mounting said members in a laterally spaced apart, coaxial relationship with each other with said second ends extending upwardly and said first ends extending downwardly;

a conical deflector positioned at said second ends of said tubular member, said deflector having its apex directed towards said inner member;

means for adjustably positioning said deflector axially with respect to said open second ends for maximum efficiency of combustion of the particulate fuel;

means for projecting upwardly a stream of air mixed with the combustible fuel into said first end of said inner tubular member, said means including a nozzle extending into a portion of said inner tubular member and a blower forcing the air and fuel mixture through said nozzle into said inner tubular member;

and means positioned near said nozzle for igniting said air and fuel mixture.

2. The apparatus according to claim 1 wherein said mounting means includes a support spider, said open first ends of said tubular members being disposed therein.

3. The apparatus according to claim 2 wherein said igniting means includes a gun-type oil burner positioned proximate said nozzle and below said support spider, said burner including control means for terminating its operation upon establishing a continuing combustion of the fuel mixture introduced into said apparatus.

4. The apparatus according to claim 3 further including a combustion chamber constructed of oxidation resistant material, said chamber surrounding said outer tubular member in spaced apart relation thereto.

5. The apparatus according to claim 1 further including a plurality of spaced apart, perforated helical vanes extending in a generally upward direction between said tubular members.

6. A burner structure designed for burning particulate fuels such as saw dust and the like within a heater unit, comprising:

means for supporting said burner structure within said heater unit, said means including a grate and a support spider resting on said grate;

an outer perforated tubular member and a shorter, inner perforated tubular member, said members each having open first and second ends, said open first ends being disposed in said support spider, and said tubular members being spaced apart laterally;

a conical deflector positioned intermediate said tubular member second ends, said deflector being axially adjustable with respect to said open second ends;

means for projecting a stream of air and combustible particulate fuel into said inner tubular member, said means including a nozzle extending through said supporting means and into a portion of said inner tubular member, and a blower directing the particulate fuel and air through said nozzle towards said conical deflector; and means for initiating combustion of said stream of fuel and air, said means including a gun-type oil burner positioned adjacent said nozzle and below said supporting means, said gun-type oil burner having control means for terminating its operation after continuing combustion of the particulate fuel within the tubular members has been established.

7. The burner structure according to claim 6 further including a plurality of spaced, perforated helical vanes extending in a generally upward direction between said inner and outer tubular members.

8. The burner structure according to claim 6 further including a combustion chamber constructed of oxidation resistant material, said chamber surrounding said outer tubular member in spaced apart relation thereto.

* * * * *